United States Patent [19]

Spicar

[11] 3,978,442

[45] Aug. 31, 1976

[54] CLAMPING OF TRANSFORMER WINDINGS BY MEANS OF HYDRAULIC POWER AMPLIFIERS

[75] Inventor: Erich Spicar, Ludvika, Sweden

[73] Assignee: Allmanna Svenska Elektriska Aktiebolaget, Vasteras, Sweden

[22] Filed: Oct. 14, 1975

[21] Appl. No.: 622,370

[30] Foreign Application Priority Data

Nov. 8, 1974 Sweden ..... 7414034

[52] U.S. Cl. ..... 336/92; 336/197; 336/210

[51] Int. Cl.[2] ..... H01F 27/26; H01F 27/30

[58] Field of Search ..... 336/92, 197, 210; 310/214, 217, 218

[56] References Cited

UNITED STATES PATENTS 3,564,472 2/1971 Frowein ..... 336/210 X

*Primary Examiner*—Thomas J. Kozma

[57] ABSTRACT

For hydraulically clamping transformer windings, hydraulic pressure generating boxes are arranged between the bottom wall of the transformer tank and a plate which supports the transformer yoke. The transformer coils which surround the legs are supported from the plate by clamping boxes which are connected by conduits to the pressure generating boxes to transmit hydraulic pressure therebetween.

2 Claims, 2 Drawing Figures

CLAMPING OF TRANSFORMER WINDINGS BY MEANS OF HYDRAULIC POWER AMPLIFIERS

BACKGROUND OF THE INVENTION

To avoid short-circuiting in transformer windings, it is a requirement that they should at all times, and independently of the temperature of the transformer, be prestressed with a certain compressive stress. The plastic settling of the insulating material, however, leads to a gradual decrease of the clamping force. Because the insulating material has a considerably greater coefficient of thermal expansion than the core material, a thermal increase of pressure takes place with rising temperature and a corresponding thermal decrease of pressure with decreasing temperature. At low temperatures the prestress may be zero.

SUMMARY OF THE INVENTION

The present invention relates to a device for clamping transformer windings hydraulically.

According to the invention, a plate is provided on which the yoke rests and between this plate and the coils there are arranged clamping boxes, the pressure in which is transmitted to the ends of the coils. Between the plate and the bottom wall of the transformer are pressure generating boxes. The clamping and pressure generating boxes are connected by conduits for transmitting hydraulic pressure between the boxes.

By arranging pressure-generating boxes below the active part of the transformer, a hydraulic pressure is obtained in such boxes which corresponds to the weight of the active part. This pressure is utilized according to the invention in order to achieve a substantially constant clamping pressure on the windings, independent of the settling occurring in the insulating material within the winding during the drying procedure and/or during the subsequent field operation of the transformer.

DESCRIPTION OF THE PREFERRED EMBODIMENTS

Figure 1:
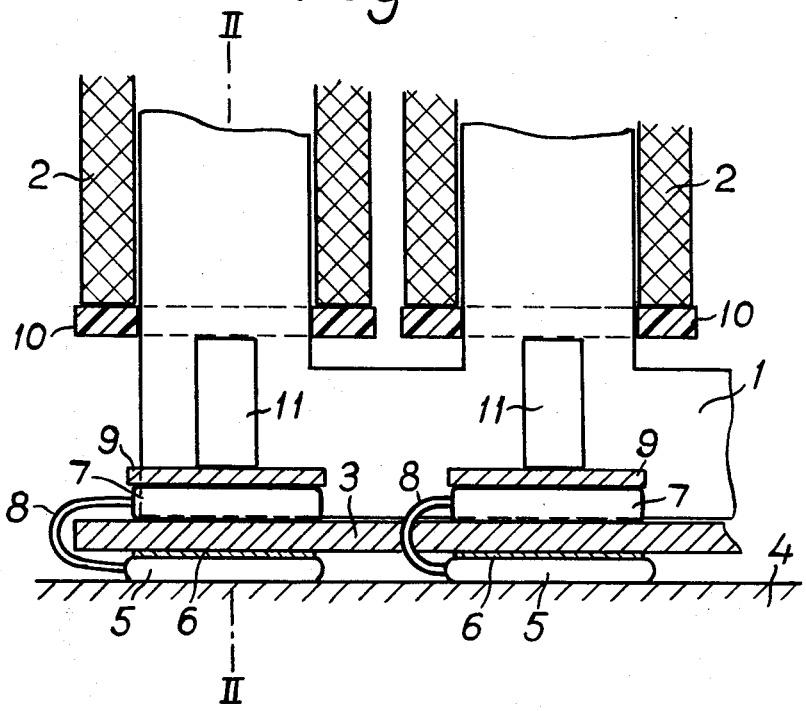
FIG. 1 shows a part of a transformer core with windings seen from the side.
Figure 2:
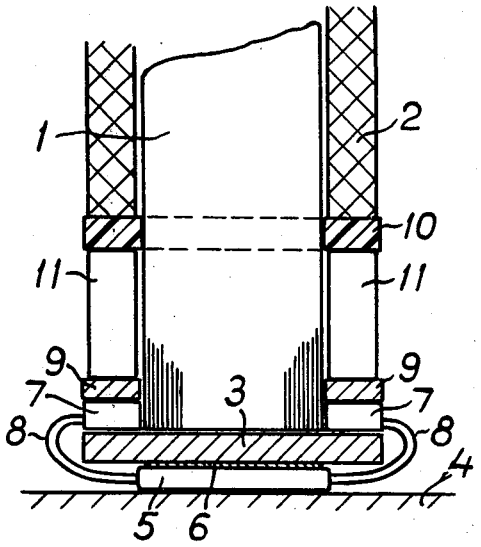
FIG. 2 is a section along the line II—II of FIG. 1.

The transformer core 1 with windings 2 is erected on and firmly joined to a support plate 3. Between the support plate and the bottom 4 of the transformer tank there are a number of hydraulic pressure-generating boxes 5. Inserts 6 may be placed between the support plate and the tank bottom.

On top of the support plate and below the windings there are a number of hydraulic boxes 7 for generating a clamping force on the winding. These boxes are therefore called clamping boxes. The pressure-generating boxes 5 and the clamping boxes 7 are joined to each other by means of hoses 8 to form a closed hydraulic system. Support plates 9 are positioned above the pressure-generating boxes. The windings 2 rest on circular pressure plates 10. Between the pressure plates and the support plates a number of insulating pillars 11 are placed. The compressive force from the clamping boxes will therefore be transmitted through the pillars 11 to the windings as a clamping force directed towards the upper yoke.

The weight P of the active part creates an average pressure p in the pressure-generating boxes 5, p being equal to P/A, where A equals the pressure area of the boxes. This pressure is propagated through the hoses 8 to the boxes 7, which, through the pillars 11, act on the pressure plates 10 with a force $Q = p \times B$, where $B$ is the cross-sectional area of the boxes 7. Thus, a power amplification is obtained, Q/P − B/A, and it will be possible to achieve a suitable clamping pressure on the windings by varying B/A for a certain value of $p$.

The whole device with boxes 5 and 7 may be made low and lies on the tank bottom, where the temperature is low. Preferably an entirely closed system is used, where the boxes are constructed as rubber bellows supported in steel armatures. As a hydraulic liquid there is used a suitable oil, for example a transformer oil, so that a leakage from the hydraulic system will not disturb the operation of the transformer. An external manometer may be used for controlling the pressure in the system. When putting the device into operation, the system is pumped up to the pressure p, according to the above. The hose connections between the boxes 5 and 7 are suitably dimensioned so that these connections have a high flow resistance in case of a short-circuit (rapid progress).

The erection of the active part of the transformer on hydraulic boxes, as shown, also results in a damping of the humming noise from the core, which noise is normally transmitted directly from the core to the tank.

The proposed device with hydraulic power amplification can be used also when drying the windings. The boxes 5 and 7 are suitably constructed as rings when pressure plates at the ends of the winding are used and a central bolt for compressing the windings, one pressure plate corresponding to the support plate 3. When using outer draw rods between the pressure plates, only boxes are used as shown in the drawings.

I claim:

1. In a transformer having a core (1) and windings (2), and having means supporting the core, means for hydraulically clamping the transformer windings comprising at least one hydraulic pressure-generating box (5) on which the supporting means rests, at least one clamping box (7) arranged between the lower ends of the windings and the supporting means, and means joining the pressure-generating boxes (5) and clamping boxes (7) transmitting hydraulic pressure between the boxes.

2. A device according to claim 1, in which the transformer includes a tank having a bottom, and the support means comprises a support plate (3), the pressure-generating boxes being arranged between the support plate (3) and the transformer tank bottom and the clamping boxes being arranged between the lower end surface of the winding and the support plate.

* * * * *